US006481932B1

(12) United States Patent
Riemers

(10) Patent No.: US 6,481,932 B1
(45) Date of Patent: Nov. 19, 2002

(54) MARINE STRUCTURE

(75) Inventor: Mark Erik Riemers, Woerden (NL)

(73) Assignee: Suction Pile Technology B.V., Woerden (NL)

( * ) Notice: Subject to any disclaimer, the term of this patent is extended or adjusted under 35 U.S.C. 154(b) by 1 day.

(21) Appl. No.: 09/713,210

(22) Filed: Nov. 16, 2000

(51) Int. Cl.[7] ..... B63B 35/42; B63B 35/44

(52) U.S. Cl. ..... 405/224.1; 405/196; 405/205; 114/266

(58) Field of Search ..... 405/195.1–200, 405/203, 205, 223.1–224.1; 114/264–266, 296

(56) References Cited

U.S. PATENT DOCUMENTS

| | | | | |
|---|---|---|---|---|
| 3,817,040 A | | 6/1974 | Stevens | 405/228 |
| 4,109,477 A | * | 8/1978 | Vogel | 405/207 |
| 4,257,721 A | | 3/1981 | Haynes | 405/227 |
| 4,432,671 A | * | 2/1984 | Westra et al. | 114/296 |
| 4,648,750 A | * | 3/1987 | Horton | 405/203 |
| 6,099,207 A | * | 8/2000 | Bennett | 405/196 |
| 6,200,069 B1 | * | 3/2001 | Miller | 114/265 |

FOREIGN PATENT DOCUMENTS

| | | |
|---|---|---|
| EP | 0 011 894 | 6/1980 |
| WO | WO 95/20075 | 7/1995 |
| WO | WO 99/51821 | 10/1999 |

* cited by examiner

*Primary Examiner*—Thomas B. Will
*Assistant Examiner*—Tara L. Mayo
(74) *Attorney, Agent, or Firm*—Young & Thompson

(57) ABSTRACT

The marine structure includes a platform above a body of water and having at least three spaced upright supporting legs extending downwards from the platform towards the body of water, at the lower side of which a suction pile is connected wherein each supporting leg is connected to the relevant suction pile externally from its longitudinal axis. The supporting leg laterally projects outside the radial circumference of the suction pile while the suction piles and the supporting legs are mutually arranged such that the suction piles are present outside the space delimited between the supporting legs and a floater extends through the space delimited by the supporting legs.

15 Claims, 4 Drawing Sheets

V
3
4

3
VI
4

MARINE STRUCTURE

FIELD OF THE INVENTION

The invention concerns a marine structure, a method of installing a marine structure and a suction pile. Particularly, the invention concerns application to a so called "minimal platform".

BACKGROUND OF THE INVENTION

Suction piles and their way of installing are, for example, known from GB-B-2300661 and EP-B-0011894, which disclosures are incorporated herein by reference. Briefly, a suction pile is a thin walled steel cylinder, closed at at least one longitudinal end, that is located on the subsea bottom with the opposite end and penetrates the subsea bottom with the aid of a suction created within the cylinder. The creation of the suction can be with the aid of a suction source, such as a pump, being on, or close to or at a distance (e.g. above the water surface, e.g. at a vessel) from the suction pile. The applied level of the suction can be e.g. at least substantially constant, smoothly increase or decrease or else pulsate, for which there are convenient means; for an e.g. pulsating level a possibly in the suction pile integrated pressure accumulator that is intermittently connected to the inner space of the cylinder.

After use, the suction pile can easily be removed by creating an overpressure within the cylinder, e.g. by pumping in (sea)water.

A self installing platform applying suction piles which provide buoyancy is known from WO99/51821 of the present inventor.

Instead of installing a suction pile into the under water bottom by generating a fluid pressure difference between the inside and outside of the suction pile, it is also feasible that the suction pile at least partly penetrates the under water bottom by a weight resting on it, e.g. the platform and/or a ballast body.

SUMMARY OF THE INVENTION

Therefor according to the invention it is proposed to make the marine structure self floating and self foundating/installing by providing it with buoyancy and one or more suction piles. So the hoisting device and the foundation plant can be eliminated. Preferably the structure has buoyancy of its own, e.g. obtained by the with the structure integrated appliance that is designed to, once the structure is installed, ballast the structure. Buoyancy can also be obtained from the suction pile, which for that can be provided with a floater. Said own buoyancy is preferably such that it is substantially contributing to the required buoyancy to make the structure self floating. It is preferable, if the buoyancy can be at least substantially decreased for installation purposes. By e.g. filling the one or more floating bodies with ballast, like water. Therefor it is convenient, to provide the structure with means for admitting and possibly removing of ballast, such as between the closed and open position switchable shutter valves in a water supplying respectively water venting opening to a ballast tank.

Since the structure is self floating and is provided with one or more suction piles, removal after use is made easier. On the one hand in that by pressing out the suction pile, the anchoring of the structure to the underwater bottom can be removed. On the other hand in that the structure can independently rise to the water surface by the (possibly regained) buoyancy.

In this respect the marine structure typically will be relatively small, e.g. a production platform with equipment. Due to its own weight, such marine structure is designed to be applied with a foundation of pile bodies to be pressed in the bottom. The marine structure preferably has, apart from the suction piles, no floating bodies, apart from parasitic floating bodies such as air filled spaces that are normally present, such as frame tubes. The marine structure according the the present invention will typically weigh not more than about 50,000 kilo, although structures with a much higher weight of e.g. 300,000 kilo or more are also feasible.

For the purpose of transporting to the final destination it is prefered that the platform rests on a barge or other separate floating and/or sailing body. Preferably said barge has insufficient buoyancy of its own to keep the marine structure floating, considering the prevailing safety requirements. The one or more suction piles provide the additionally required buoyancy. "Barge" means at least a vessel known as such with one or more floating spaces at least substantially hermetically delimited from the environment. Preferably the barge has no equipment of its own for propelling and/or directional control.

Thus a cost and time and energy and environmental saving is possible, and also the work is safer.

To provide the additional buoyancy, the suction pile is preferably provided with a floating means. The floating means can at least substantially comprise a space in open communication with the surrounding water at its under side, such as the pressure space of the suction pile, e.g. if the suction pile will float in the water at least as much upright as possible. If one can keep said space free of water to a satisfying level, the desired buoyancy can be maintained without requiring to delimit this floating space at all sides with respect to the water environment. Said space can therefor e.g. be connected to a convenient means, such as for delivering a gas generating dry compound into said space, or for delivering into said space a pressurised gas, such as a pump, to generate a convenient gas pressure in the suction space and to possibly maintain it against the pressure of the surrounding water. Due to the movements of the floating suction pile in the water, it is expected that without counter measurements this space will be filled more and more with water from below. A remedy is to continuously or intermittendly removing of the incoming water by e.g. refilling said space with gas, for which said above mentioned means is/are continuously or intermittendly activated. In this connection it is preferred to integrate this means in an active, preferably automatic, e.g. electronic control circuit wherein said means is activated in dependency from the detection of the buoyancy of the suction pile at different times, such as by measuring e.g. the water surface or e.g. the gas pressure within said space with e.g. a convenient sensor, outputting its measuring signal to an evaluation device comparing the measuring signal with an input value, switching on or letting switching on said means to get back to the initial situation once a treshold difference value is exceeded.

Application of the above described space in open communication with its surrounding water has drawbacks in view of ensuring the buoyancy. It is therefor preferable if said floating means provides one or more floating spaces that are delimited at all sides with respect to the water environment and that are filled with a floating substance, such as air or a gas or some other material of relatively low specific weight. Said floating means can comprise e.g. a seperate, inflatable, completely closed, diafragm type floating body, preferably within the suction pile, e.g. in the suction space. With e.g. a space of the suction pile that is open at its lower side, use can be made of an airtight bulkhead with which said opening can be sealed. If said bulkhead is at least substantially rigid, e.g. of metal, preferably steel, of sufficient thickness, it can withstand a pressure difference between said space and its environment by bearing bending stresses, hoop stresses or a combination of both. Then it is for realising and maintaining the desired buoyancy not necessary to bring this space to a pressure that is substantially higher than atmospheric pressure. If the bulk-head is substantially flexible, e.g. as an elastic or plastic excellent deformable membrane of e.g. rubber, it can be necessary for obtaining and maintaining sufficient buoyancy to bring this space to a pressure substantially higher than atmospheric pressure.

To be able to obtain the desired pressure within the pressure space it is prefered that said space is hermetically limited. It is prefered to connect the pressure space with a convenient means to supply said space with pressurised gas.

The meaning of "delimited at all sides with respect to the water environment" here is that a boundary with respect to the surrounding air is not required. The meaning of "hermetically delimited" here is a boundary both with respect to the surrounding water and the surrounding air.

The invention is also concerned with a method for transporting a marine structure over water making use of one or more suction piles with buoyancy, providing at least substantially all buoyancy of said marine structure.

BRIEF DESCRIPTION OF THE DRAWINGS

The invention is further illustrated by way of a non-limiting, presently preferred embodiment providing the best way of carrying out the invention and shown in the drawings.

DETAILED DESCRIPTION OF THE INVENTION

Figure 2:
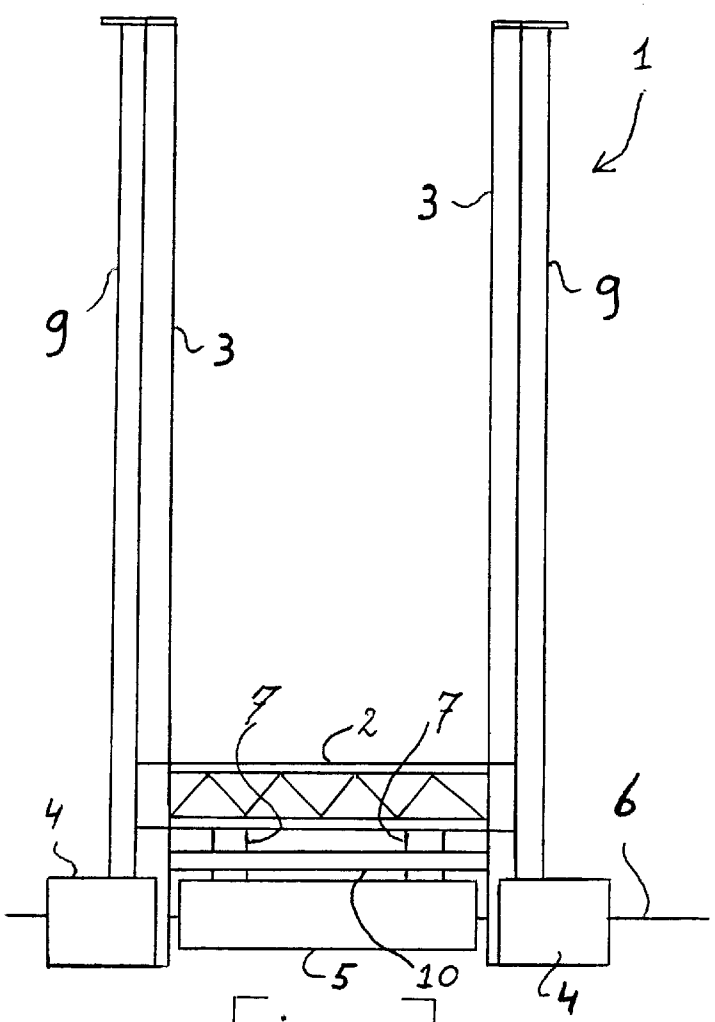
FIG. 2 shows a front view of the structure of FIG. 1.
Figure 1:
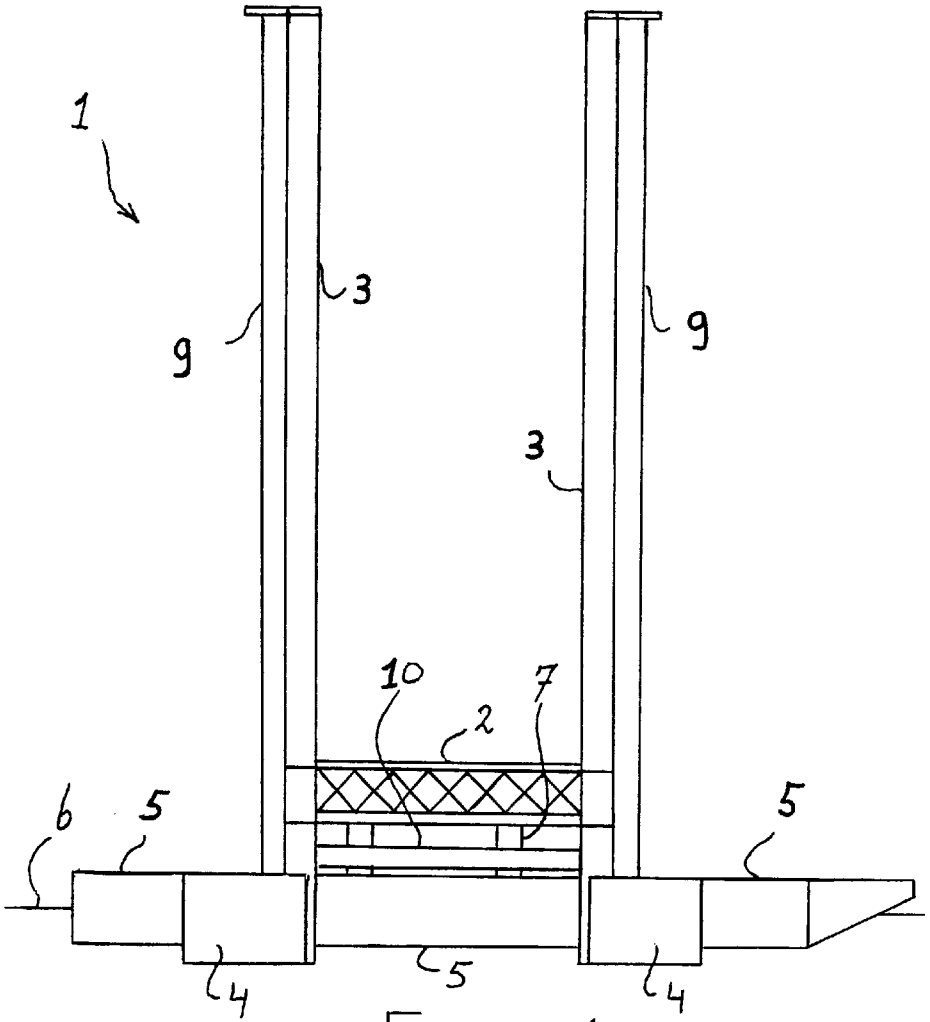
FIG. 1 shows a side view of a marine structure prior to installation.
Figure 7:
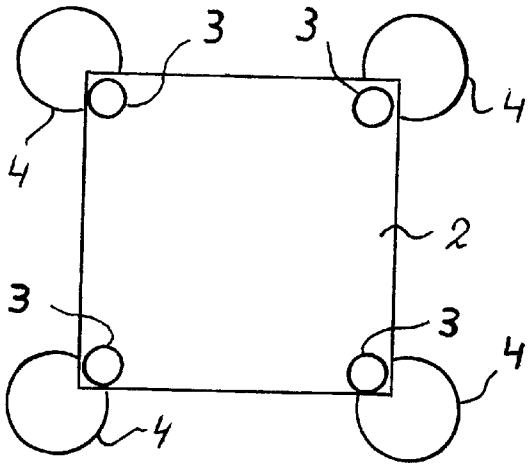
FIG. 7 shows a top view of the arrangement of FIG. 3
Figure 3:
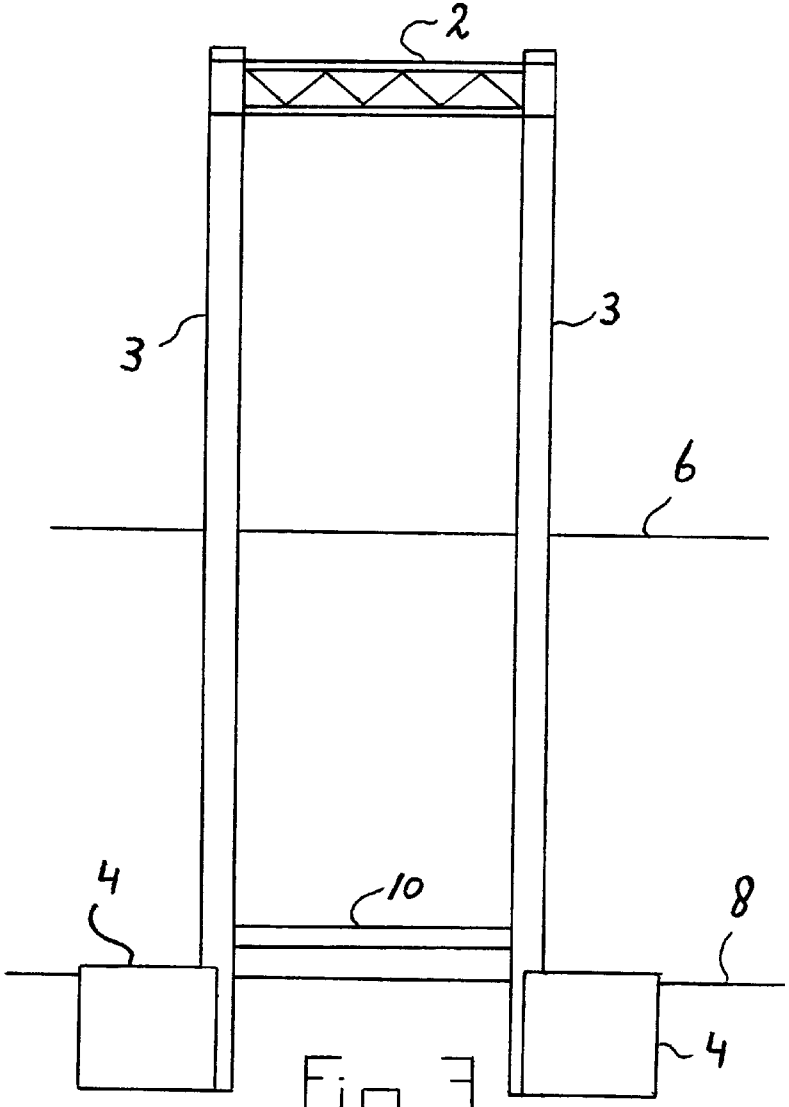
FIG. 3 shows a view according to FIG. 1, after installation.

FIGS. 1–3 and 7 show a marine structure 1 consisting of a platform 2, rectangular in top view, each corner of which having a supporting leg 3 at the lower side of which a suction pile 4 is connected. The supporting legs 3 are mutually connected by braces 10. Each supporting leg 3 is connected to the suction pile 4 externally from its longitudinal axis. In this example the suction piles 4 and the supporting legs 3 are mutually arranged such that the suction piles are present outside the space delimited between the supporting legs 3. Thus the space between the supporting legs is completely available to a barge 5, providing a floating transport means. The buoyancy provided by the barge can therewith be optimised. This is also beneficial for the stability during transport across the water 6.

During transport over water, the supporting legs 3 are retracted. The marine structure is at least partly supported by the barge 5 and the platform 2 is preferably close to the water surface 6. Therefor, the platform 2 preferably rests directly onto the barge 5, possibly through supports 7. The barge offers all required buoyancy, or the barge and the suction piles 4 together offer the required buoyancy. The suction piles 4 project preferably partly above the water, which is beneficial for the stability.

During installation, the supporting legs 3 and the platform 2 are mutually shifted in longitudinal direction of the supporting legs 3, such that the lower side of the supporting legs 3 move away from the platform 2. One can proceed in at least the two following manners:

1. One lifts the structure 1 from the barge 5, preferably by increasing the buoyancy of the suction piles 4, whereafter one disengages the barge 5 from the structure 1 and removes it. Subsequently one lowers the suction piles 4 together with the lower side of the supporting legs 3 onto the under water bottom 8, while one shifts the platform 2 along the supporting legs 3 to remain at least substantially at the same level above the water surface. After the suction piles 4 are penetrated into the under water bottom 8, preferably to their final depth, the platform 2 is lifted to its final level, shifting along the supporting legs 3.

2. While the structure 1 rests onto the barge 5 floating in the water, one lowers the suction piles 4 onto the under water bottom 8 together with the supporting legs 3. After the suction piles 4 have penetrated the under water bottom 8, preferably to their final depth, the barge 5 is removed and the platform 2 lifted.

To be able to mutually shift the supporting legs 3 and the platform 2, convenient means can be present, such as cables 9 and driven winches.

Figure 4:
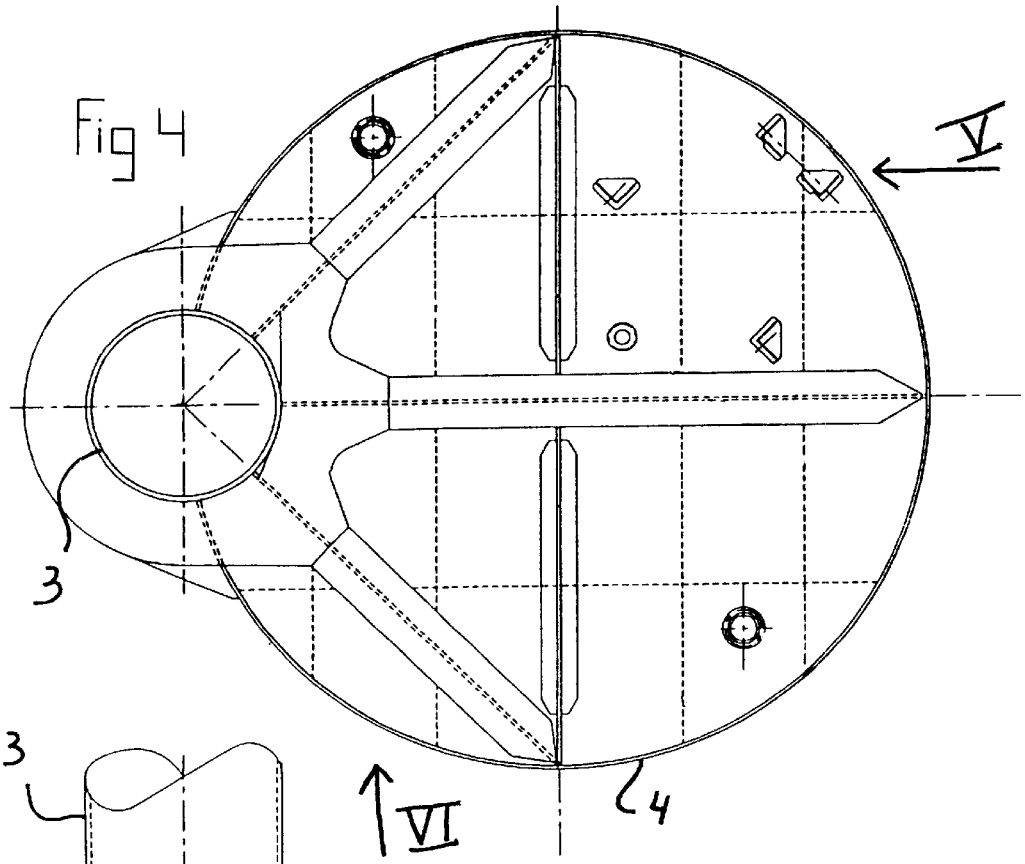
FIG. 4 shows a top view of a suction pile.
Figure 6:
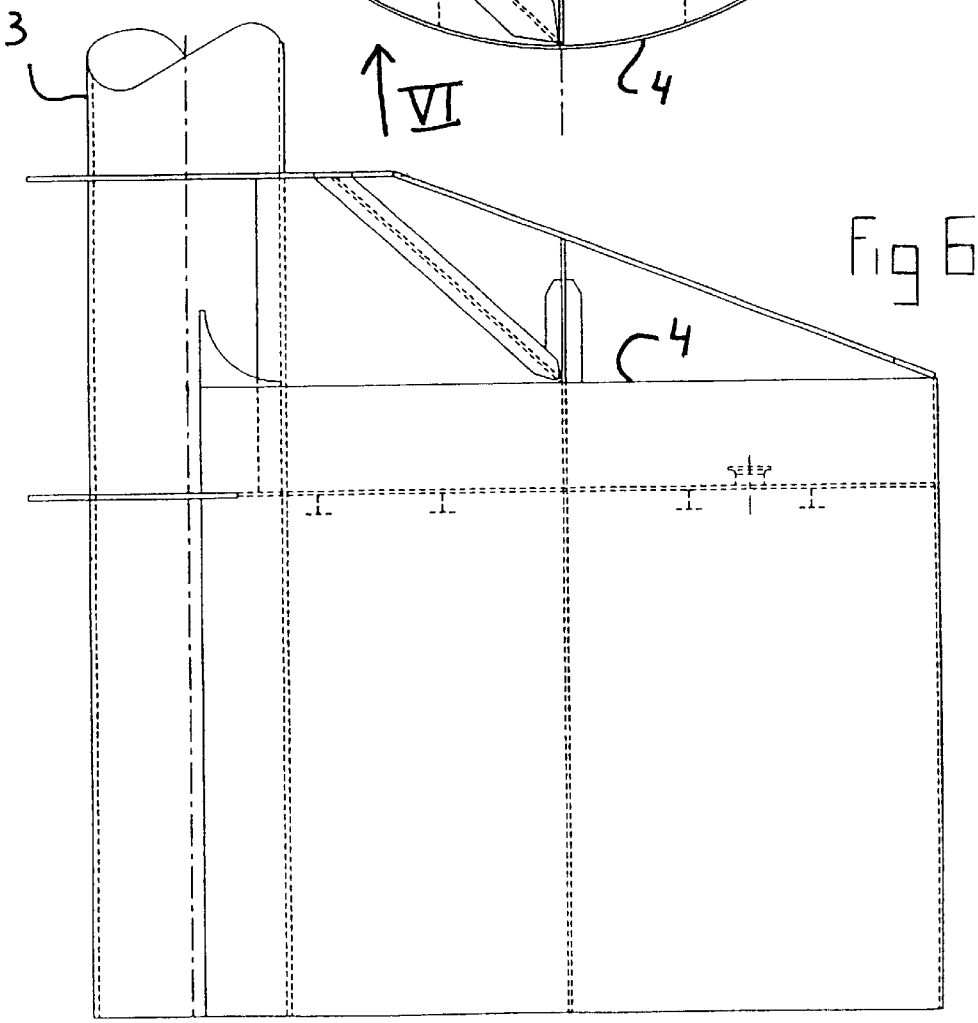
FIG. 6 shows a side view according to arrow VI in FIG. 4.
Figure 5:
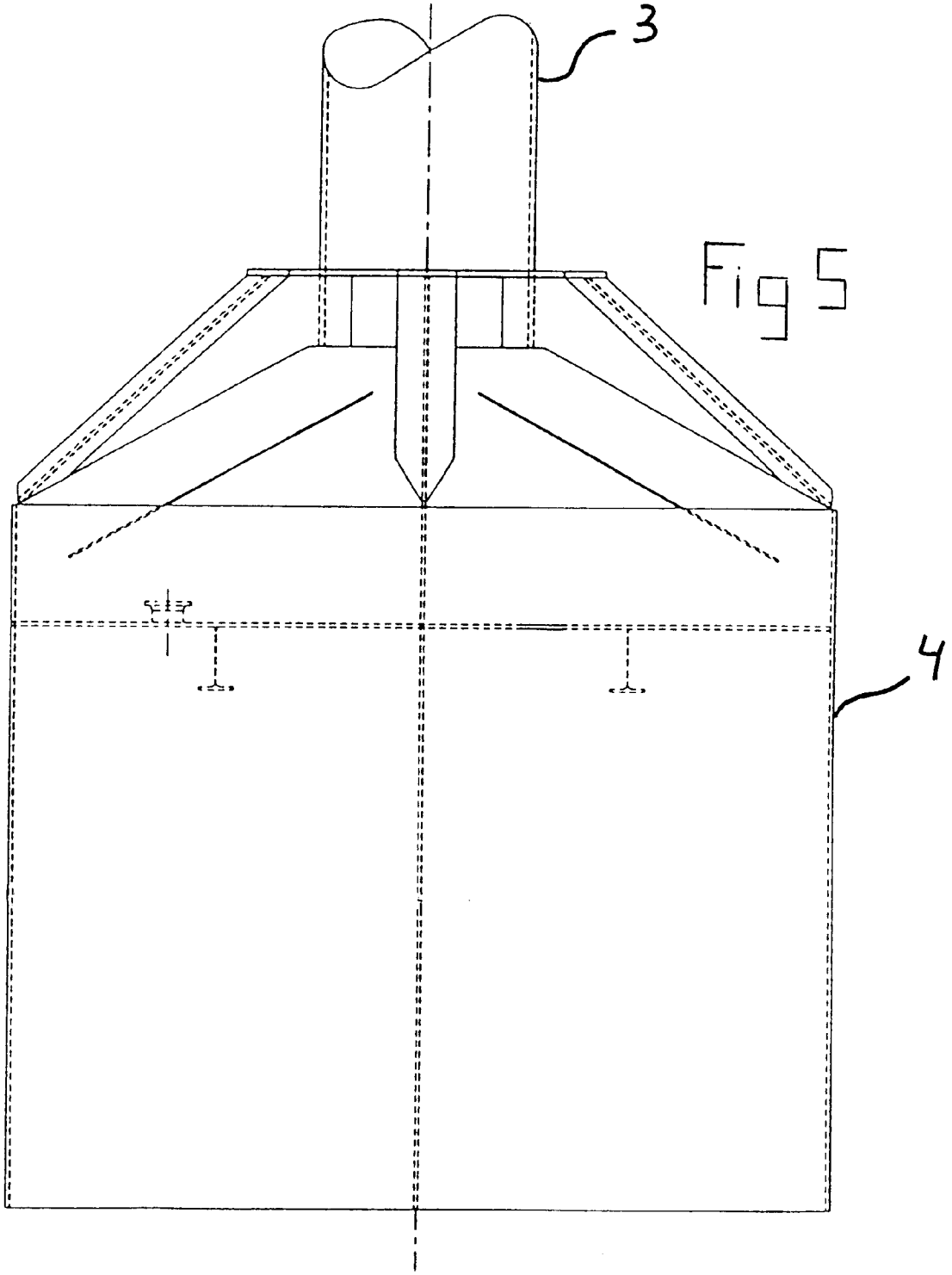
FIG. 5 shows a view according to arrow V in FIG. 4.

FIGS. 4–6 show that the supporting leg 3 preferably laterally projects outside the radial circumference of the suction pile 4 and extends preferably over at least the complete height of the suction pile 4. The suction pile 4 has a height between e.g. 5 m and 10 m. A separate suction pile designed for use with this marine structure is characterised by means for asymmetric mounting to the supporting leg 3. Therefor the suction pile contains e.g. in its radial side wall a relief to receive the supporting leg and/or local stiffening for the asymmetric mounting of the supporting leg. With the prior art suction pile, the supporting leg is always coaxially mounted to the suction pile.

The invention is not limited to the above described and in the drawings illustrated embodiments. E.g. the marine structure can have less than four, e.g. three, or more than four, e.g. five or six, suction piles 4. The number of supporting legs 3 is preferably equal to the number of suction piles 4, but this is not absolutely necessary. E.g. three suction piles are at the corners of a structure 1 that is triangular in top view. It is not required that the suction piles and supporting legs are at the corners of the structure 1. The platform 2 can be constructed and/or shaped differently. Instead of an embodiment wherein the suction piles are external from the space between the supporting legs 3, an embodiment is feasible wherein the suction piles 4 are within the space delimited by the supporting legs.

The marine structure is e.g. assembled from a sub frame, comprising the suction piles and their mutual connecting braces. The platform and the supporting legs 3 can be a separate sub assembly. The sub frame is lowered onto the water bottom such that the suction piles thereof penetrate the bottom. Then the sub frame and sub assembly are coupled, wherein the sub assembly is supported by a barge. Then the supporting legs are lifted, taking the suction piles with them. The marine structure supported by the barge can now be towed to the final location.

In another production variant, the platform is constructed with clamps, the number of which equals the number of supporting legs. First the platform is located on a barge floating in the water. Then an upright supporting leg mounted to a suction pile is mated with a corresponding clamp and the clamp is closed such that the marine structure is ready to be towed to its final location.

In again another production variant, the supporting legs are pivotably mounted, such that they can pivot from a substantially vertical position to a substantially horizontal position. In the latter position, the suction piles at their lower ends can completely extend above the water while the platform rests on a barge, such that in this position the stability during towing is assured. At the final location, the supporting legs are pivoted to their upright position such that the suction piles can be lowered to penetrate the water bottom.

What is claimed is:

1. A marine structure floating in a body of water, the structure comprising:

a platform above the body of water;

at least three spaced, substantially upright supporting legs extending downwards from the platform towards the body of water; and a suction pile connected to a lower side of each said supporting leg, wherein each supporting leg laterally projects outside the radial circumference of a corresponding said suction pile.

2. The marine structure according to claim 1, wherein each supporting leg extends over at least substantially the complete height of a corresponding said suction pile.

3. The marine structure according to claim 1, further comprising below the platform a floater floating in the body of water, said floater extending through the space delimited by the supporting legs.

4. The marine structure according to claim 3, wherein said floater has two opposite longitudinal sides and wherein the suction piles are on both longitudinal sides of the floater.

5. The marine structure according to claim 3, wherein the suction piles penetrate the surface of the body of water such that they extend partly above and partly into the water in a transport position.

6. The marine structure according to claim 3, wherein the floater and the suction piles commonly provide the required buoyancy of the marine structure.

7. The marine structure according to claim 1, further comprising mounting means for mounting the supporting legs to the platform such that the supporting legs can slide relative to the platform in the longitudinal direction of the supporting legs, such that the lower side of the supporting legs can be moved away from the platform.

8. A marine structure floating in a body of water, the structure comprising:

a platform above the body of water;

at least three spaced substantially, upright supporting legs extending downwards from the platform towards the body of water; and a suction pile connected to a lower side of each said supporting leg, wherein the suction piles and the supporting legs are mutually arranged such that the suction piles are present outside the space delimited between the supporting legs, and further comprising below the platform a floater floating in the body of water, said floater extending through the space delimited by the supporting legs; and wherein the suction piles penetrate the surface of the body of water such that they extend partly above and partly into the water in a transport position.

9. A marine structure floating in a body of water, the structure comprising:

a platform above the body of water;

at least three spaced substantially, upright supporting legs extending downwards from the platform towards the body of water; and a suction pile connected to a lower side of each said supporting leg, wherein each said supporting leg is at a distance from the longitudinal axis of the relevant suction pile at the level of the top of the suction pile.

10. The marine structure according to claim 9, wherein each said supporting leg crosses the radial circumference wall of the relevant suction pile.

11. The marine structure according to claim 9, further comprising below the platform a floater floating in the body of water, said floater extending through the space delimited by the supporting legs.

12. The marine structure according to claim 11, wherein said floater has two opposite longitudinal sides and wherein the suction piles are on both longitudinal sides of the floater.

13. The marine structure according to claim 11, wherein the suction piles penetrate the surface of the body of water such that they extend partly above and partly into the water in a transport position.

14. The marine structure according to claim 11, wherein the floater and the suction piles commonly provide the required buoyancy of the marine structure.

15. The marine structure according to claim 9, further comprising mounting means for mounting the supporting legs to the platform such that the supporting legs can slide relative to the platform in longitudinal direction of the supporting legs, such that the lower side of the supporting legs can be moved away from the platform.

* * * * *